US012398878B2

(12) United States Patent
Said

(10) Patent No.: US 12,398,878 B2
(45) Date of Patent: Aug. 26, 2025

(54) INSTRUMENTED BURNER

(71) Applicant: FIVES PILLARD, Marseilles (FR)

(72) Inventor: Fouad Said, Marseilles (FR)

(73) Assignee: FIVES PILLARD, Marseilles (FR)

( * ) Notice: Subject to any disclaimer, the term of this patent is extended or adjusted under 35 U.S.C. 154(b) by 537 days.

(21) Appl. No.: 17/789,471

(22) PCT Filed: Dec. 22, 2020

(86) PCT No.: PCT/FR2020/052587
§ 371 (c)(1),
(2) Date: Jul. 26, 2022

(87) PCT Pub. No.: WO2021/130443
PCT Pub. Date: Jul. 1, 2021

(65) Prior Publication Data

US 2023/0037353 A1 Feb. 9, 2023

(30) Foreign Application Priority Data

Dec. 27, 2019 (FR) ..... 1915672

(51) Int. Cl.
*F23C 5/06* (2006.01)
*F23N 5/24* (2006.01)

(52) U.S. Cl.
CPC ..... *F23C 5/06* (2013.01); *F23N 5/24* (2013.01); *F23D 2208/10* (2013.01)

(58) Field of Classification Search
CPC ..... F23N 5/24; F23C 5/06; F23D 2208/10
See application file for complete search history.

(56) References Cited

U.S. PATENT DOCUMENTS 2,960,047 A 11/1960 Oberhuber
2016/0238246 A1* 8/2016 Albright ..... F23N 1/022

FOREIGN PATENT DOCUMENTS

JP H04270815 A 9/1992
WO 2015168278 A1 11/2015
WO 2021130443 A1 7/2021

OTHER PUBLICATIONS

Foreign Communication from a Related Counterpart Application, International Search Report dated Mar. 10, 2021, International Application No. PCT/FR2020/052587 filed on Dec. 22, 2020.
Foreign Communication from a Related Counterpart Application, Written Opinion dated Mar. 10, 2021, International Application No. PCT/FR2020/052587 filed on Dec. 22, 2020.

* cited by examiner

*Primary Examiner* — Alfred Basichas
(74) *Attorney, Agent, or Firm* — Conley Rose, P.C.

(57) ABSTRACT

The invention relates to a fuel burner (2) that is to be integrated into a furnace (3) or a boiler and is arranged in said furnace (3) or said boiler in a target position, the burner (2) comprising means (C1-C9) for measuring an offset relative to the target position.

11 Claims, 1 Drawing Sheet

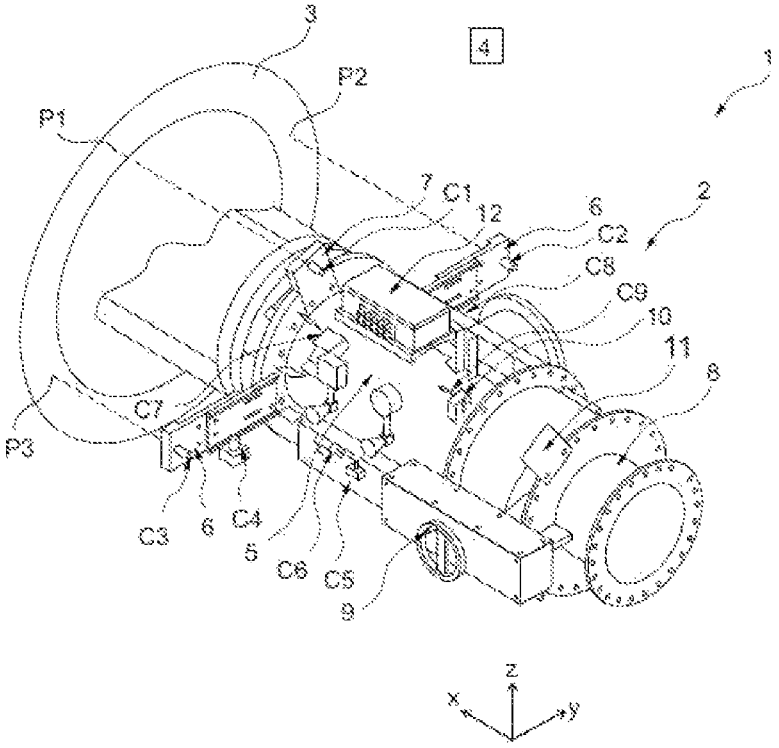
3
4
1
P2
P1
7
C1
12
6
2
C2
C8
C9
10
11
8
C7
P3
C3
6
C4
5
C6
C5
9
z
x
y

INSTRUMENTED BURNER

CROSS-REFERENCE TO RELATED APPLICATIONS

The present application is a filing under 35 U.S.C. 371 as the National Stage of International Application No. PCT/FR2020/052587, filed Dec. 22, 2020, entitled "INSTRUMENTED BURNER," which claims priority to French Application No. 1915672 filed with the Intellectual Property Office of France on Dec. 27, 2019, both of which are incorporated herein by reference in their entirety for all purposes.

TECHNICAL FIELD OF THE INVENTION

The invention relates to a burner that is to be integrated into, for example, an industrial furnace or boiler. The invention relates more specifically to instrumented burners equipped with position sensors. The invention also relates to an installation comprising such a burner and a method of controlling the installation in order to optimize the operation of said installation.

TECHNICAL BACKGROUND

Burners are used in many industries. They are a key element in many industrial installations.

Examples of these installations include clinker production plants intended ultimately for the production of cement, and domestic hot water or steam production networks.

Installations with integrated burners and one or more sensors for measuring temperatures to obtain thermal profiles are known. Installations with sensors to analyze various characteristics of the flame, such as imaging means, are also known.

These installations with such monitoring systems claim to improve the quality of calcination in the kilns and/or to reduce carbon monoxide and nitrogen oxide emissions.

Although progress has been made in this direction, many problems remain.

The adjustment of the burner's target position in the furnace or boiler is done empirically, that is by making several successive tests. The target position depends on the industrial sector in which the burner is used. These settings are made during the assembly of the installation and refined after start-up.

The target position is chosen so that the calcination meets the quality standards of the end product, for example, clinker for cement production, while minimizing carbon monoxide and nitrogen oxide emissions. It should also be noted that legislation is becoming stricter regarding the emission of these pollutants.

During the use of the installations, the quality of the calcination may decrease and the emissions of pollutants may increase. This is the result of several factors alone or combined together.

Examples of these factors include:

- mechanical drift and fatigue of the burner, which cause the burner to shift in relation to the furnace,
- a modification of the fuel characteristics, in particular the enrichment of the mixture, which has an impact on the calcination quality and on the emissions,
- problems with fuel changes due to raw material prices, which change the combustion properties.

The invention aims to remedy the above-mentioned disadvantages.

SUMMARY OF THE INVENTION

For this purpose, a fuel burner is proposed that is to be integrated into a furnace or boiler and is arranged in said furnace or boiler in a target position, the burner comprising means for measuring an offset relative to the target position.

Such a burner equipped with measuring means can advantageously detect a positioning error in relation to the furnace or boiler. Actions can then be taken to correct the positioning.

Various additional features can be provided alone or in combination:

- the measuring means are able to measure an overall offset of said burner with respect to the furnace or boiler;
- the measuring means are able to measure an offset between sub-assemblies of said burner;
- the burner comprises a body with measuring means;
- the burner comprises a plurality of distance sensors capable of measuring a distance separating the furnace or boiler from the body of said burner, each sensor pointing to a point located on the furnace along a longitudinal axis of the burner and each point being distinct from the other;
- the burner comprises a sinking sensor able to measure a distance between the burner body and the furnace and/or boiler, said distance being measured along a longitudinal axis of the burner;
- the burner comprises a height sensor adapted to measure a height of the body of said burner;
- the burner comprises at least one sensor able to measure a dynamic pressure in one of the supply lines of said burner;
- the burner further comprises an adjusting piece adapted to change an operating point in the burner, said adjusting piece being movable, said burner comprising measuring means adapted to measure a distance and/or an inclination between the body and the adjusting piece;

Secondly, an installation is proposed comprising a burner as previously described and a furnace or boiler and a computer, the burner being arranged in the furnace or boiler, the installation further comprising a connection means connected to the sensors and able to receive measurements from said sensors and to communicate said measurements to the computer, the computer being able to process the measurements received from the connection means.

Thirdly, a method for controlling an installation as previously described is proposed, wherein said method comprises the following steps:

- measuring an instantaneous position of the burner,
- sending the measurements of the instantaneous position of the burner to the computer,
- comparing the measurements of the instantaneous position of the burner with a predetermined target position,
- alerting if an offset between the instantaneous position and the target position is detected.

Various additional features can be provided alone or in combination:

- the method indicates the adjustments to be made to the burner position in order to return to a target position;
- the method automatically carries out modifications of the combustion parameters according to the measured shifts and/or modifications of the burner position in order to return to a target position.

BRIEF DESCRIPTION OF THE FIGURES

Further features and advantages of the invention will become apparent from the following detailed description, which may be understood with reference to the attached drawing in which:

The FIG. 1 is a perspective view of an installation according to the invention.

DETAILED DESCRIPTION OF THE INVENTION

FIG. 1 shows an installation 1 according to the invention. The installation 1 comprises a burner 2, a furnace 3 and a computer 4.

The burner 2 is arranged in a furnace but can also be arranged in a boiler.

In the furnace 3, the burner 2 is arranged in a predetermined position, hereinafter referred to as the target position. This position is determined empirically, that is by carrying out a series of successive tests. The target position corresponds to the position in the furnace 3 in which the calcination is the most efficient, that is which has the best quality yield while limiting fuel consumption and the production of pollutants such as nitrogen oxides and carbon monoxide.

For various reasons related to the use of the burner 2, it can deviate from its target position; this offset is an involuntary drift when it is related to mechanical wear. This drift is multidimensional in the sense that it can appear in all three dimensions of space.

For other reasons, it may be worthwhile to deviate from the target position, especially when a different fuel is used. Indeed, a target position may be associated with a fuel, and the use of another fuel may require a deviation from the target position. In this case, the offset is not an unintentional drift, but rather an offset intended to improve the performance of the calcination.

The burner 2 advantageously comprises means C1-C9 capable of measuring the drift, that is an offset between the target position and the instantaneous position of the burner 2.

The measuring means C1-C9 are able to measure an overall drift of the burner 2 with respect to the furnace 3. Moreover, the measuring means C1-C9 are also able to measure a drift of the burner 2 sub-assemblies in relation to each other as will be described later.

There is defined, in a non-limiting way and without reference to terrestrial gravity, a trihedron comprising:

- an X-axis defining a direction of extension of the burner 2,
- a transverse Y-axis perpendicular to the X-axis and defining together with the Y-axis an XY plane,
- a vertical Z-axis perpendicular to the X- and Y-axes and defining respectively with those axes, an XZ plane and a YZ plane.

The burner 2 comprises a body 5 on which the measuring means C1-C9 are arranged. As shown in FIG. 1, the measuring means C1-C9 are positioned on the body 5, so that when the burner 2 is arranged in the furnace 3, the measuring means C1-C9 are located outside said furnace 3.

Among the measuring means, the burner 2 comprises two distance sensors C2, C3. The distance sensors C2, C3 are each able to measure a distance between the furnace 3 and the body 5 of the burner 2. This distance is measured along the X axis. The sensors C2, C3 point in the direction of the furnace 3, along the X axis. They are advantageously mounted on lateral lugs 6 which project laterally in a direction substantially perpendicular to the X axis. The lateral lugs 6 allow the sensors C2, C3 to be laterally separated so that no element of the burner 2 interferes with the measurements made. Moreover, by moving the C2 and C3 sensors laterally, the accuracy of the measurement is improved in that any drift will be more obvious.

Each distance sensor C2, C3 points towards the furnace 3 respectively at a point P2, P3 distinct from each other and located on said furnace 3.

Advantageously, the burner 2 comprises a sinking sensor C1. The sinking sensor C1 is able to measure a distance between the furnace 3 and the body 5 of the burner 2. This distance is measured along the X-axis. The sinking sensor C1 is advantageously mounted on an upper lug 7 projecting from the body 5 of the burner 2 in a direction substantially perpendicular to the X-axis. The upper lug 7 makes it possible like the lateral lugs 6, to laterally separate the sinking sensor C1 so that no element of the burner 2 interferes with the measurements made. The sinking sensor C1 points towards the furnace 3 at a point P1 which is different from the points P2, P3.

Advantageously, the burner 2 comprises a height sensor C4. The height sensor C4 is arranged on one of the lateral tabs 6. The height sensor C4 is able to measure the height of the body 5 of the burner 2. This height is measured in relation to a reference element such as a floor, but it can be another reference element depending on the arrangement of the burner 2. The height sensor C4 measures along the Z-axis.

As previously mentioned, the burner 2 advantageously comprises a sub-assembly sensor C9 capable of measuring a drift of a sub-assembly of the burner 2. As can be seen in FIG. 1, the burner 2 has an adjusting part 8 intended to modify at least one parameter of the combustion. The adjusting part 8 is mobile and can be moved by means of a handle 9. The subassembly sensor C9 is able to measure the distance of the adjusting part 9 from the burner body 5 of the burner 2. Like the sensors C1, C2, C3, the sensor C9 is arranged on a fixing lug 10 projecting from the body 5 of the burner 2. The subassembly sensor C9 points to a board 11 mounted on the adjusting part 8.

The sensors C1, C2, C3, C4, C9 use ultrasonic technology. This technology is particularly interesting since it allows measurements to be taken in difficult conditions where temperatures are high and in a sometimes dusty environment.

The lugs 6, 7 are advantageously adjustable in position so as to modify the position of the sensors they accommodate. This allows the sensors to be offset by more or less depending on the furnace or boiler receiving the burner.

Advantageously, the burner 2 comprises a tilt sensor C5. The tilt sensor C5 is mounted directly on the body 5. This tilt sensor C5 advantageously makes it possible to measure a drift of the tilt of the body 5 with respect to a target tilt.

The burner advantageously comprises sensors C6, C7, C8 capable of measuring a dynamic pressure in the burner 2. The measurement of the dynamic pressure makes it possible to determine the speed of the fuel and/or the oxidizer. The pressure sensors C6, C7, C8 are arranged on the body 5 of the burner 2 in several different places in order to make the measurements reliable.

Advantageously, the burner 2 comprises a connection means 12 able to receive the measurements made by the sensors C1-C9. The connection means 12 is for example an electronic junction box. The connection means 12 is able to centralize and send the measurements made by the sensors C1-C9 to the computer 4. The connection means 12 is connected to the sensors C1-C9 by a wire connection not shown in FIG. 1. The connection means 12 sends the measurements to the computer 4. The connection means 12 can send the measurements by wired or wireless technology. The computer 4 is for example a computing unit.

The computer 4 processes the measurements made as described in the following.

The invention further relates to a method for controlling the installation 1. The information about the target position of the burner 2 is stored in the computer 4 beforehand.

This control method comprises:

- a step of measuring the instantaneous position of the burner 2 with the measuring sensors C1-C9,
- a step of sending the instantaneous position of the burner 2 to the computer 4 by means of the junction box 12,
- a step of comparing the measurement of the instantaneous position of the burner 2 with the target position, this step being performed by the computer 4,
- an alert step if a drift is detected, that is if an offset has been measured.

The alert consists of a message sent to a control center. Several actions can then be taken depending on the drift that has been measured. A first action may be to reposition the burner to its target position. This can be done manually or automatically when the burner is motorized. A second action can be to modify the combustion parameters according to the type of drift that is measured and its importance in order to maintain the quality of the calcination.

In more detail, the method comprises several steps, each inherent to a particular measurement performed via the C1-C9 sensors.

Thus the method comprises:

- a step of measuring a distance between the furnace 3 and the body 5 of the burner 2 by means of the sinking sensor C1,
- a step of sending these measurements to the computer 4 by means of the junction box 12,
- a step of comparing the measured instantaneous sinking of the burner 2 in the furnace 3 with a target sinking,
- a step of alerting and/or correcting the position of the burner 2 and/or the combustion parameters if a difference is detected between the measured instantaneous sinking and the target sinking.

These steps of the method make it possible to correct a possible drift along the X-axis of the burner with respect to the furnace.

The method further comprises:

- a step of measuring a first instantaneous distance between the furnace 3 and the body 5 of the burner by means of the distance sensor C2,
- a step of measuring a second instantaneous distance between the furnace 3 and the body 5 of the burner 2 by means of the distance sensor C3,
- a step of sending these measurements to the computer 4 by means of the junction box 12,
- a step of comparing the first instantaneous distance with a first target distance and the second instantaneous distance with a second target distance,
- a step of alerting and/or correcting the position of the burner 2 and/or the combustion parameters if a difference is detected between the first instantaneous distance and the first target distance and/or a difference is detected between the second instantaneous distance and the second target distance.

These steps of the method make it possible to correct a potential lateral drift of the burner 2, that is if the burner 2 is in an inclined position with respect to the furnace 3.

The method further comprises:

- a step of measuring an instantaneous height by means of the height sensor C4,
- a step of sending that instantaneous height to the computer 4 by means of the junction box 12,
- a step of comparing the instantaneous height and the target height,
- a step of alerting and/or correcting the position of the burner 2 and/or the combustion parameters if a difference is detected between the instantaneous height and the target height.

These steps of the method make it possible to correct a potential drift along the Z axis of the burner.

The method further comprises:

- a step of measuring an instantaneous tilt by means of the tilt sensor C5,
- a step of sending that instantaneous tilt to the computer 4 by means of the junction box
- a step of comparing the instantaneous tilt and the target tilt,
- a step of alerting and/or correcting the position of the burner 2 and/or the combustion parameters if a difference is detected between the instantaneous tilt and the target tilt.

These steps of the method make it possible to correct a potential drift of the burner 2 tilt, that is an involuntary rotation of the burner around the Y-axis.

The method further comprises:

- a step of measuring an instantaneous dynamic pressure by means of at least one of the pressure sensors C6, C7, C8,
- a step of sending that instantaneous pressure to the computer 4 by means of the junction box 12,
- a step of calculating an instantaneous average velocity of the oxidizer flow in the burner thanks to the dynamic pressure measurements,
- a step of comparing the instantaneous average velocity and the target velocity,
- a step of alerting and/or correcting the combustion parameters if a difference is detected between the instantaneous average velocity and the target average velocity.

These steps of the method make it possible to correct a potential drift of the flow velocity in the burner, which can have an impact on burner efficiency. This drift can occur with repeated fuel changes or if there are unintentional drifts in the oxidizer/fuel ratio.

This installation and its control method have several advantages, including:

- detecting burner offsets in relation to the furnace,
- modifying the fuel characteristics, in particular the enrichment of the mixture, which has an impact on the calcination quality and on the emissions,
- problems with fuel changes due to raw material prices, which change the combustion properties.

The invention claimed is:

1. A fuel burner intended to be integrated into a furnace or a boiler and arranged in said furnace or said boiler in a setpoint position, the burner comprising:

- sensors able to measure an offset with respect to the setpoint position, the burner comprising a body in which the sensors are able to measure an overall offset of said burner with respect to the furnace or to the boiler, wherein the burner further comprises an adjusting part able to modify an operating point in the burner, said adjusting part being mobile, the sensors being able to measure a distance and/or an inclination between the body and the adjusting part.

2. The fuel burner according to claim 1, wherein the sensors are able to measure an offset between sub-assemblies of said burner.

3. The burner according to claim 1, wherein it comprises a body comprising the sensors.

4. The burner according to claim 1, wherein the sensors comprise a plurality of distance sensors capable of measuring a distance separating the furnace or the boiler from the body of the said burner, each distance sensor pointing towards a point situated on the furnace along a longitudinal axis of the burner and each point being distinct from one another.

5. The burner according to claim 1, wherein the sensors comprise a sinking sensor capable of measuring a distance between the body of the burner and the furnace and/or the boiler, said distance being measured along a longitudinal axis of the burner.

6. The burner according to claim 1, wherein the sensors comprise a height sensor able to measure a height of the body of said burner.

7. The burner according to claim 1, wherein the sensors comprise a tilt sensor able to measure a tilt of the body of said burner.

8. The burner according to claim 1, wherein the sensors comprise at least one sensor capable of measuring a dynamic pressure in one of the supply pipes of said burner.

9. An installation comprising a burner according to claim 1 and a furnace or boiler and a computer, the burner being arranged in the furnace or boiler, the installation further comprising an electronic junction box connected to the sensors and able to receive measurements from said sensors and to communicate said measurements to the computer, the computer being able to process the measurements received from the electronic junction box.

10. A method of controlling the installation according to claim 9, wherein said method comprises the following steps:

measuring an instantaneous position of the burner, sending the measurements of the instantaneous position of the burner to the computer, comparing the measurements of the instantaneous position of the burner with a predetermined target position, alerting if an offset between the instantaneous position and the target position is detected, and adjusting the burner position with an adjusting part able to modify an operating point in the burner, said adjusting part being mobile, in order to return to a target position.

11. The control method according to claim 10 wherein the method automatically makes changes to the combustion parameters as a function of the measured offsets and/or changes to the burner position in order to return to a target position.

* * * * *